US009227390B2

(12) United States Patent
Endo et al.

(10) Patent No.: US 9,227,390 B2
(45) Date of Patent: Jan. 5, 2016

(54) NUMBERING AND IMPRINTING MACHINE

(71) Applicants: Yutaka Endo, Ibaraki (JP); Kenji Ida, Ibaraki (JP); Hiroto Nagura, Ibaraki (JP)

(72) Inventors: Yutaka Endo, Ibaraki (JP); Kenji Ida, Ibaraki (JP); Hiroto Nagura, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 13/738,722

(22) Filed: Jan. 10, 2013

(65) Prior Publication Data

US 2013/0180419 A1 Jul. 18, 2013

(30) Foreign Application Priority Data

Jan. 13, 2012 (JP) ..... 2012/004734
Jan. 13, 2012 (JP) ..... 2012/004736

(51) Int. Cl.

| | |
|---|---|
| ***B41K 3/12*** | (2006.01) |
| ***B41F 13/00*** | (2006.01) |
| ***B41F 33/00*** | (2006.01) |
| ***B41F 33/04*** | (2006.01) |
| ***B41F 33/08*** | (2006.01) |

(Continued)

(52) U.S. Cl.

CPC ..... *B41F 13/0032* (2013.01); *B41F 33/009* (2013.01); *B41F 33/045* (2013.01); *B41F 33/08* (2013.01); *B41F 33/10* (2013.01); *B41F 33/14* (2013.01); *B41F 35/02* (2013.01); *B41F 35/04* (2013.01); *B41K 3/12* (2013.01); *B41P 2235/21* (2013.01); *B41P 2235/23* (2013.01); *B41P 2235/26* (2013.01)

(58) Field of Classification Search

CPC .... B41F 1/565; B41F 13/0032; B41F 33/009; B41F 33/045; B41K 3/10; B41K 3/102; B41K 3/266

USPC ..... 101/76, 77, 72, 423, 425, 348, 6, 350.1

See application file for complete search history.

(56) References Cited

U.S. PATENT DOCUMENTS 3,937,642 A * 2/1976 Kronseder et al. ..... 156/384
5,255,606 A * 10/1993 Iijima et al. ..... 101/425

(Continued)

FOREIGN PATENT DOCUMENTS

CN 1267597 A 9/2000
CN 101269571 A 9/2008

(Continued)

*Primary Examiner* — Matthew G Marini

(74) *Attorney, Agent, or Firm* — Blakely Sokoloff Taylor & Zafman LLP

(57) ABSTRACT

This invention discloses a numbering and imprinting machine including a number cylinder, moving inker, first cleaning device, second cleaning device, inker position detector, and control device. The number cylinder includes at least one numbering device. The moving inker includes a number inker which supplies ink onto the number cylinder, and is movable between a printing position at which the number inker comes into contact with the number cylinder, and a retraction position at which the number inker separates from the number cylinder. The first cleaning device cleans the number cylinder. The second cleaning device cleans the number inker. The inker position detector detects the position of the moving inker. When the inker position detector detects that the moving inker is set at the printing position, the control device rotates the number cylinder, drives the number inker and controls cleaning operations by the first cleaning device and the second cleaning device.

8 Claims, 7 Drawing Sheets

(51) Int. Cl.

| | |
|---|---|
| ***B41F 33/10*** | (2006.01) |
| ***B41F 33/14*** | (2006.01) |
| ***B41F 35/02*** | (2006.01) |
| ***B41F 35/04*** | (2006.01) |

(56) References Cited

U.S. PATENT DOCUMENTS

| | | | | |
|---|---|---|---|---|
| 6,354,202 | B1 * | 3/2002 | Heiler | 101/148 |
| 6,588,337 | B1 * | 7/2003 | Kreckel et al. | 101/424 |
| 2003/0159606 | A1 | 8/2003 | Kolbe et al. | |
| 2008/0229954 | A1 | 9/2008 | Saito et al. | |
| 2010/0294149 | A1 | 11/2010 | Kusaka | |

FOREIGN PATENT DOCUMENTS

| | | | |
|---|---|---|---|
| CN | 101511594 | A | 8/2009 |
| CN | 101890832 | A | 11/2010 |
| EP | 1728628 | | 6/2005 |
| EP | 1 338 418 | B1 | 9/2005 |
| JP | S63-281883 | A | 11/1988 |
| WO | WO 2006/129245 | A2 | 12/2006 |

* cited by examiner

NUMBERING AND IMPRINTING MACHINE

BACKGROUND OF THE INVENTION

The present invention relates to a numbering and imprinting machine which prints a number on an object to be printed.

A numbering and imprinting machine of this type includes a number cylinder, ink supply device, and moving inker, as disclosed in Japanese Patent Laid-Open No. 63-281883. The number cylinder is pivotally supported by main body frames, and prints a number on an object to be printed. The ink supply device supplies ink onto the number cylinder via a roller group. The moving inker is movably supported by the main body frames so that the ink supply device comes close to or separates from the number cylinder.

In the conventional numbering and imprinting machine as described above, in cleaning the ink supply device, the moving inker is set at a printing position at which a number is printed, and the ink supply device is actuated to rotate the roller group, thereby cleaning it. On the other hand, in cleaning the number cylinder, the number cylinder must be removed from the main body frames, and cleaned manually by the operator. It is therefore necessary to clean the ink supply device and the number cylinder in independent cleaning processes, which take a considerable time. It is also necessary to mount and remove the number cylinder on and from the main body frames to clean it, thus imposing a heavy burden on the operator.

SUMMARY OF THE INVENTION

It is an object of the present invention to provide a numbering and imprinting machine which can efficiently clean a number cylinder and an ink supply device by shortening the time to clean them.

It is another object of the present invention to provide a numbering and imprinting machine which can easily clean a number cylinder and an ink supply device by greatly relieving the physical burden imposed on the operator.

In order to solve the above-mentioned problems, a numbering and imprinting machine according to the present invention comprises a number cylinder which is rotatably supported by main body frames, and includes at least one numbering device mounted on an outer circumferential surface thereof, a moving inker which includes a number inker that supplies ink onto the number cylinder, and is movable between a printing position at which the number inker comes into contact with the number cylinder, and a retraction position at which the number inker separates from the number cylinder, a first cleaning device which is mounted on the main body frames, and cleans the number cylinder, a second cleaning device which is mounted on the moving inker and cleans the number inker, an inker position detector which detects a position of the moving inker, and a control device which, when the inker position detector detects that the moving inker is set at the printing position, rotates the number cylinder, drives the number inker and controls cleaning operations by the first cleaning device and the second cleaning device.

According to the present invention, since the numbering device is cleaned by the number cylinder cleaning device while the ink supply device is cleaned by the inker cleaning device, both the numbering device and the ink supply device are easily, efficiently cleaned simultaneously with each other without imposing a significant burden on the operator. This makes it possible not only to shorten the cleaning time but also to greatly relieve the operator's burden as the need to remove the number cylinder from the main body frames is obviated.

DESCRIPTION OF THE PREFERRED EMBODIMENTS

A numbering and imprinting machine according to the present invention will be described in detail below with reference to the accompanying drawings.

<Arrangement of Numbering and Imprinting Machine>

Figure 1:
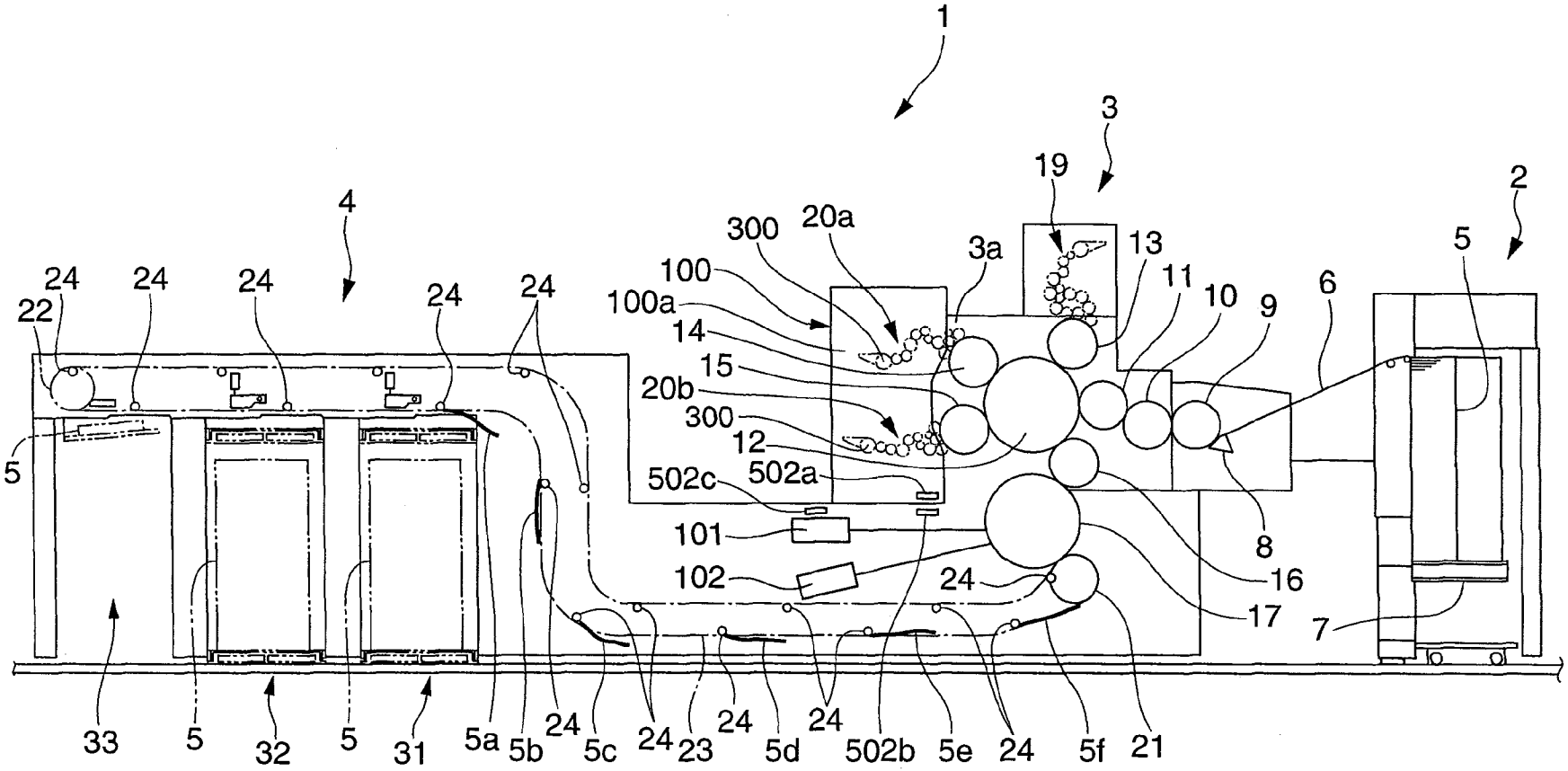
FIG. 1 is a side view showing the schematic arrangement of a numbering and imprinting machine according to an embodiment of the present invention.

A numbering and imprinting machine 1 includes a feed unit (sheet feed unit) 2 which feeds a sheet, a printing unit (sheet processing unit) 3 which prints on the sheet fed from the feed unit 2, and a delivery unit (sheet delivery unit) 4 which delivers the sheet printed by the printing unit 3, as shown in FIG. 1. The feed unit 2 includes a pile board 7 which stacks sheets (printing products) 5 having images printed on them by another printing machine, and a sucker device (not shown) which draws the sheets 5, stacked on the pile board 7, by suction one by one and conveys them to a feeder board 6. The terminal end of the feeder board 6 in the direction in which the sheet 5 is conveyed is provided with a swing arm shaft pregripper 8 which is opposed to a transfer cylinder 9 and holds and conveys the sheet 5.

A transfer cylinder 10 is opposed to the transfer cylinder 9, and is pivotally supported by a pair of main body frames 3*a*. A transfer cylinder 11 is pivotally supported by the main body frames 3*a* on the downstream side, of the contact portion of the transfer cylinder 10 with the transfer cylinder 9, in the direction in which the sheet 5 is conveyed. The transfer cylinders 9, 10, and 11 are pivotally supported by the main body frames 3*a*. The transfer cylinders 9, 10, and 11 are provided with gripper devices (not shown) for holding the forward edge (leading edge) of the sheet 5 in a gripped state.

An impression cylinder 12 is opposed to the transfer cylinder 11 on the downstream side, of the contact portion of the transfer cylinder 11 with the transfer cylinder 10, in the direction in which the sheet 5 is conveyed. A stamp cylinder 13 and number cylinders 14 and 15 are opposed to the impression cylinder 12 in the order named on the downstream side, of the contact portion of the impression cylinder 12 with the transfer cylinder 11, in the direction in which the sheet 5 is conveyed. The stamp cylinder 13 and number cylinders 14 and 15 are pivotally supported by the main body frames 3*a*. The impression cylinder 12 serves as a double-diameter cylinder having a diameter double that of each of the stamp cylinder 13 and number cylinders 14 and 15. The impression cylinder 12 is provided with a pair of gripper devices (not shown) at circumferential positions 180° out of phase with each other. These gripper devices hold the forward edge (leading edge) of the sheet 5 in a gripped state.

The stamp cylinder 13 prints a stamp on the sheet 5 which has an image printed on it and is conveyed by the impression cylinder 12. A stamp inker 19 is opposed to the stamp cylinder 13. The stamp inker 19 is supported by the stamp inker 19, and supplies ink onto the stamp cylinder 13. The stamp inker 19 includes an ink fountain and roller group (a large number of rollers).

The number cylinders 14 and 15 print numbers on the sheet 5 which has an image printed on it and is conveyed by the impression cylinder 12. A number inker (ink supply device) 20*a* is opposed to the number cylinder 14. The number inker 20*a* includes an ink fountain and an inker roller group (an ink fountain roller 301 and a large number of inker rollers). A number inker (ink supply device) 20*b* is opposed to the number cylinder 15. The number inker 20*b* includes an ink fountain and an inker roller group (an ink fountain roller 301 and a large number of inker rollers). The number inkers 20*a* and 20*b* are mounted on a pair of inker frames 100*a* of a moving inker 100.

The moving inker 100 is supported to be movable between a printing position (FIG. 1) at which the number inkers 20*a* and 20*b* come into contact with the number cylinders 14 and 15, respectively, and a retraction position (FIG. 2) at which the number inkers 20*a* and 20*b* separate from the number cylinders 14 and 15, respectively. The moving inker 100 is moved by a moving inker drive device 510 (FIG. 7) such as a motor or an oil hydraulic cylinder.

Inker position detectors 502*b* and 502*c* which detect the position of the moving inker 100 are mounted on the main body frames 3*a* corresponding to the printing position and retraction position, respectively, of the moving inker 100, as shown in FIG. 1. The inker position detectors 502*b* and 502*c* are implemented by proximity sensors which detect that an object to be detected 502*a* mounted on the inker frames 100*a* has reached a position in close proximity to them.

Note that the inker position detectors 502*b* and 502*c* are not limited to proximity sensors, and may be implemented by contact switches such as limit switches. Alternatively, the inker position detectors 502*b* and 502*c* may serve as position detectors, which detect the absolute position of the moving inker 100, such as potentiometers or laser displacement gauges. The inker position detectors 502*b* and 502*c* need only detect whether the moving inker 100 is present at the printing position (FIG. 1).

The main body frames 3*a*, impression cylinder 12, stamp cylinder 13, stamp inker 19, and number cylinders 14 and 15 constitute a main body printing unit. The inker frames 100*a* and ink supply devices (number inkers 20*a* and 20*b*) constitute the moving inker 100. The main body printing unit and moving inker 100 constitute the printing unit 3.

A transfer cylinder 16 is opposed to the impression cylinder 12 on the downstream side, of the contact portion of the impression cylinder 12 with the number cylinder 15, and on the upstream side, of the contact portion of the impression cylinder 12 with the transfer cylinder 11, in the direction in which the sheet 5 is conveyed. The transfer cylinder 16 is pivotally supported by the main body frames 3*a*. The transfer cylinder 16 is provided with a gripper device (not shown) for holding the forward edge (leading edge) of the sheet 5 in a gripped state.

An inspection cylinder 17 serving as a double-diameter cylinder is opposed to the transfer cylinder 16 on the downstream side, of the contact portion of the transfer cylinder 16 with the impression cylinder 12, in the direction in which the sheet 5 is conveyed. The inspection cylinder 17 is provided with a pair of gripper devices (not shown) at circumferential positions 180° out of phase with each other. These gripper devices hold the forward edge (leading edge) of the sheet 5 in a gripped state. A large number of suction holes (not shown) are formed in the circumferential surface of the inspection cylinder 17. These suction holes are supplied with negative-pressure air.

Inspection cameras 101 and 102 are mounted on the main body frames 3*a* to face the circumferential surface of the inspection cylinder 17. Each of the inspection cameras 101 and 102 inspects the qualities of the stamp and number (for example, the printing positions and printing densities of the stamp and number) printed on the sheet 5 which is wound around the circumferential surface of the inspection cylinder 17 and conveyed. The inspection camera 101 detects, for example, the position and density of the number printed on the sheet 5 using normal ink. The inspection camera 102 detects the position and density of the number printed on the sheet 5 using UV (Ultra Violet) ink. Note that the types of ink inspected by the inspection cameras 101 and 102 are not limited to these examples. The inspection cylinder 17 and inspection cameras 101 and 102 constitute an inspection unit.

A delivery cylinder 21 is opposed to the inspection cylinder 17 on the downstream side, of the contact portion of the inspection cylinder 17 with the transfer cylinder 16, in the direction in which the sheet 5 is conveyed. The delivery cylinder 21 is pivotally supported by the main body frames 3*a*. A pair of delivery chains 23 are looped around a pair of sprockets (not shown) coaxial with the delivery cylinder 21 and a pair of sprockets 22 disposed at the terminal end of the delivery unit 4. The delivery chains 23 convey the sheet 5 to the delivery unit 4.

A plurality of gripper bars 24 are juxtaposed on the pair of delivery chains 23 with predetermined gaps between them. The gripper bars 24 hold the forward edge (leading edge) of the sheet 5 in a gripped state. Fit sheet delivery devices 31 and 32 and an unfit sheet delivery device 33 are disposed below the delivery chains 23. A fit sheet 5 inspected by the inspection camera 101 or 102 is delivered to the fit sheet delivery device 31 or 32. An unfit sheet 5 inspected by the inspection camera 101 or 102 is delivered to the unfit sheet delivery device 33. The delivery cylinder 21, sprockets 22, delivery chains 23, gripper bars 24, first fit sheet delivery device 31, second fit sheet delivery device 32, and unfit sheet delivery device 33 constitute the delivery unit 4.

<Arrangement of Number Cylinders>

The number cylinders 14 and 15 mounted on the main body frames 3*a* of the printing unit 3 will be described below. Note that since the number cylinders 14 and 15 have the same arrangement, only the number cylinder 15 will be described hereinafter, and a description of the number cylinder 14 will be omitted for the sake of convenience.

Figure 3:
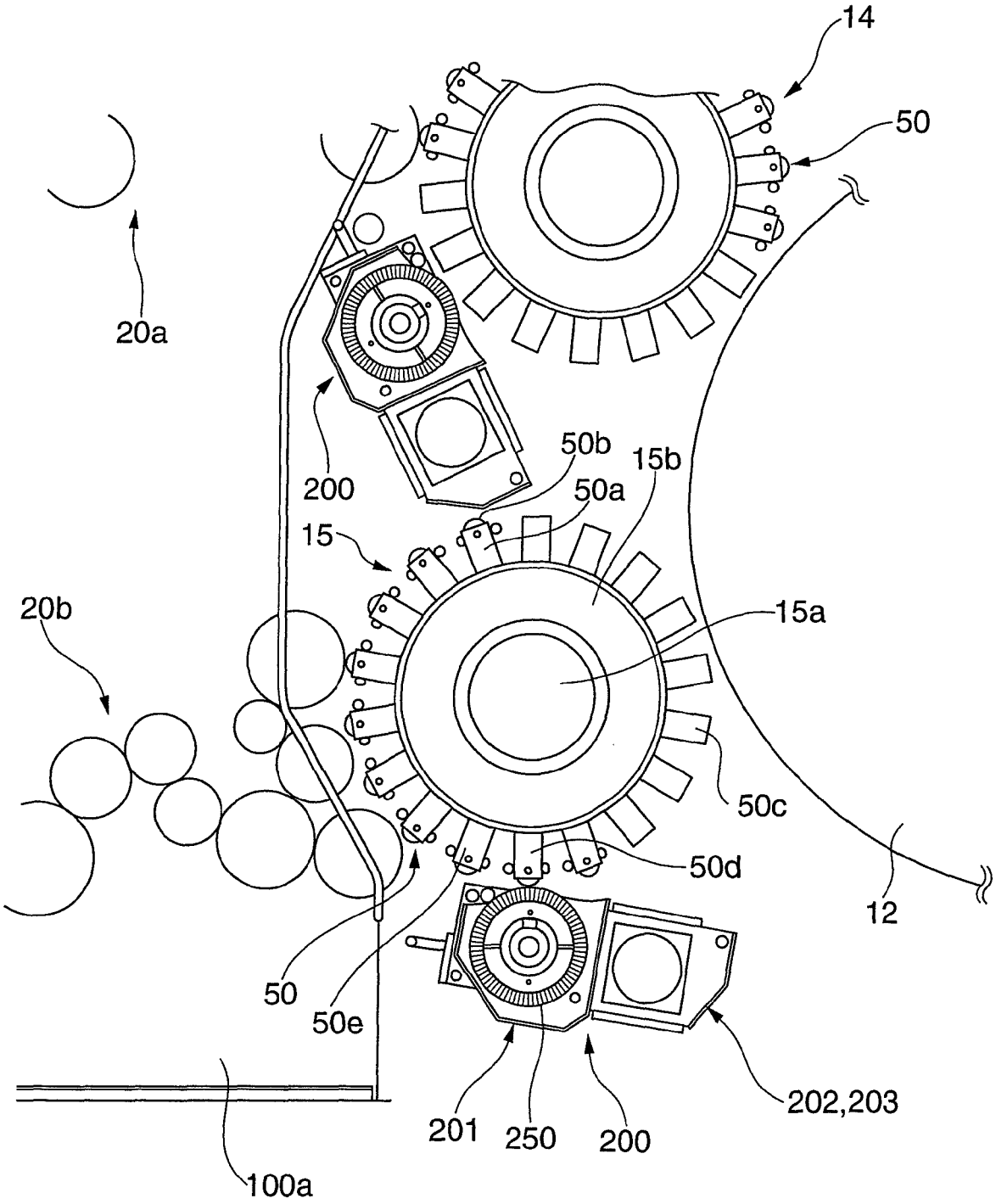
FIG. 3 is a side view showing how to clean numbering devices of number cylinders shown in FIG. 1 using brush roller units.
Figure 5:
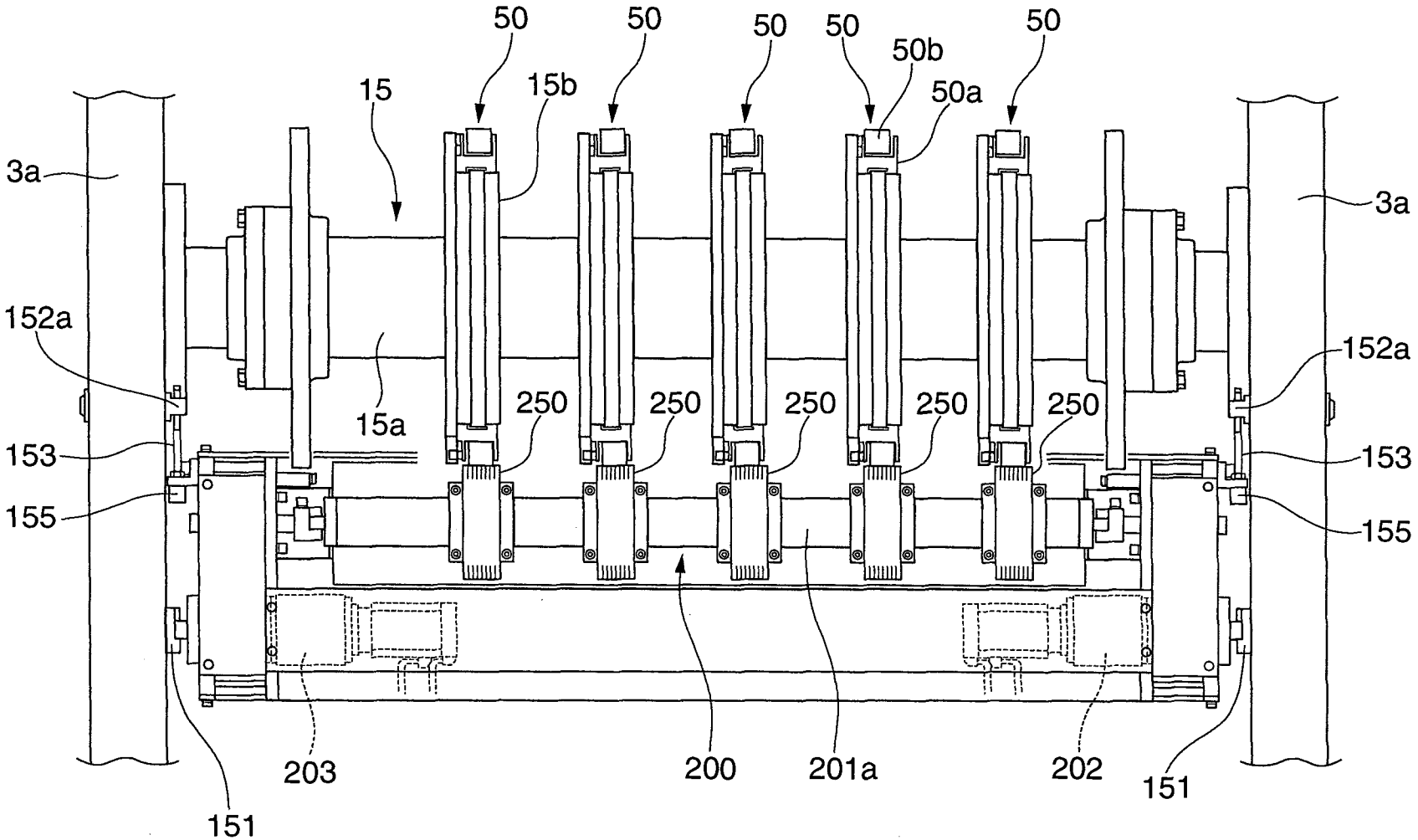
FIG. 5 is a side view showing how cleaning brushes in the brush roller unit shown in FIG. 4 come into contact with the numbering devices of the number cylinder.

A plurality of mount rings (five mount rings in this embodiment) 15*b* are juxtaposed on a cylinder shaft 15*a* of the number cylinder 15 in its axial direction, as shown in FIGS. 3 and 5. A plurality of numbering devices (10 numbering devices in this case) 50 are circumferentially mounted on the outer circumferential surface of each mount ring 15*b* with predetermined gaps between them. That is, a plurality of numbering devices 50 are arranged on the number cylinder 15 to align themselves in its axial and circumferential directions to form a matrix. A plurality of numbering devices 50 which align themselves in the axial direction of the number cylinder 15 form a numbering device line 50*d*, and 10 numbering device lines 50*d* are arranged circumferentially in this embodiment.

Each numbering device 50 includes a numbering device table 50*a* fixed to the mount ring 15*b*, and a print wheel 50*b* which is installed on the numbering device table 50*a* and prints a number on the sheet 5. Not only the 10 numbering devices 50 but also a plurality of weights (eight weights in this embodiment) 50*c* for balance adjustment are mounted on each mount ring 15*b* with predetermined gaps between them. Each weight 50*c* has the same weight as each numbering device 50, and is mounted on the mount ring 15*b* in a portion having no numbering device 50. Each weight 50*c* adds the same weight as that of each numbering device 50 to the outer circumferential surface of the mount ring 15*b* at a predetermined interval to prevent any weight imbalance. A brush roller unit (number cylinder cleaning device) 200 which cleans the print wheels 50*b* of the numbering devices 50 is removably mounted on the main body frames 3*a* in the vicinity of the number cylinder 15.

<Structure of Brush Roller Unit>

Figure 4:
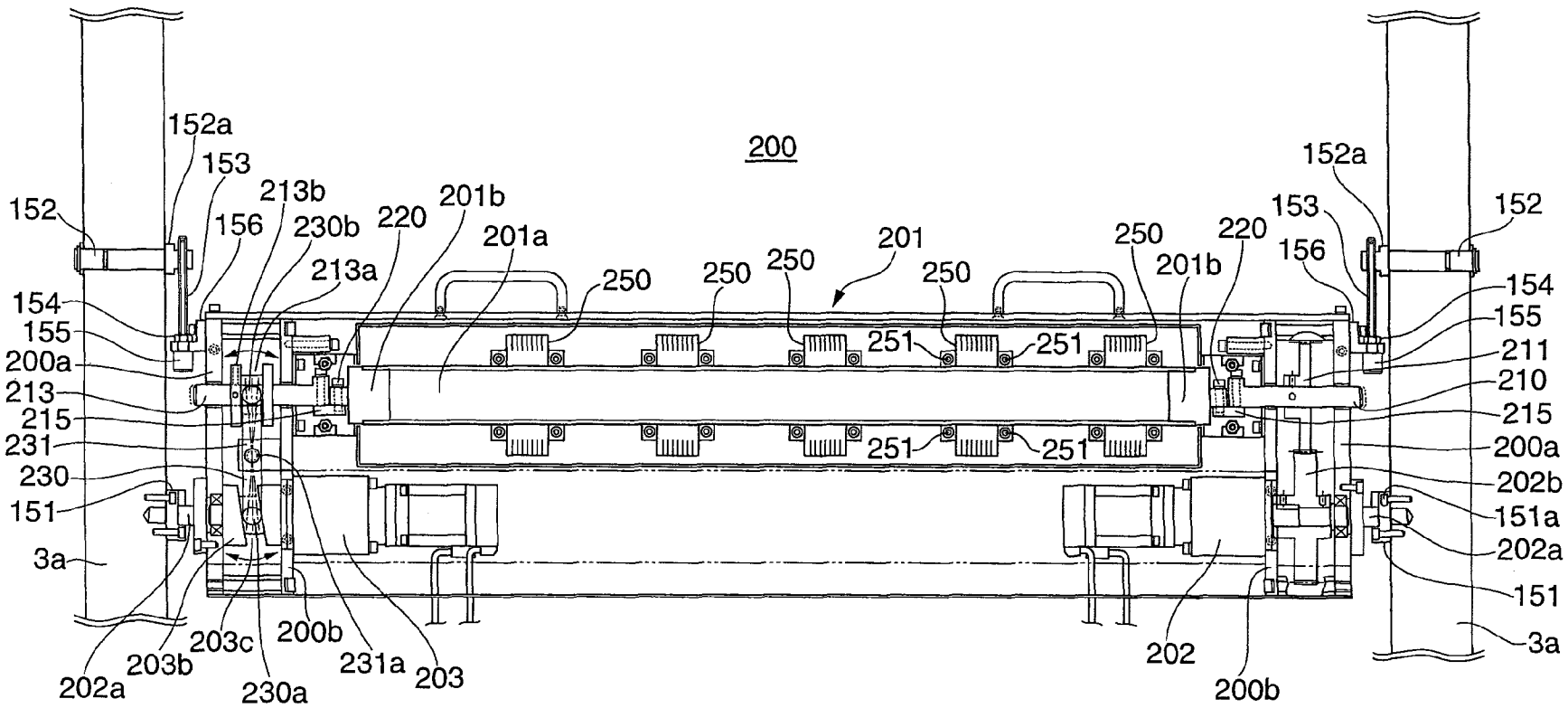
FIG. 4 is a sectional view of the brush roller unit shown in FIG. 3.

The brush roller unit 200 includes a pair of frames 200*a*, and a pair of sub-frames 200*b* fixed to portions inside the frames 200*a*, as shown in FIG. 4. An end shaft 202*a* protruding from the side surface of each frame 200*a*, which is opposed to the corresponding main body frame 3*a*, is fitted in a U-shaped recess 151*a* in a receptacle 151 fixed to this main body frame 3*a*.

An L-shaped bracket 156 is fixed to the side surface of each frame 200*a*, which is opposed to the corresponding main body frame 3*a*, and a recess is formed at the distal end of the bracket 156. A pin 152 is pivotally supported by each main body frame 3*a*, and internal threads are formed in a projecting portion 152*a* of the pin 152, which projects toward the interior of this main body frame 3*a*. The external threads of a bolt 153 threadably engage with the internal threads of the projecting portion 152*a*. The shaft of the bolt 153 is fitted in the recess of the bracket 156, and its head 155 is provided with a dial. A lock nut 154 threadably engages with the bolt 153, and clamps the bracket 156 with the head 155 to fasten the bracket 156 by the bolt 153, or cancel the fastening of the bracket 156 by the bolt 153.

A rotary shaft 210 is rotatably, axially movably supported by one of the frames 200*a* and one of the sub-frames 200*b*, and a gear 211 is fixed to it. A swing shaft 213 is rotatably, axially movably supported by the other of the frames 200*a* and the other of the sub-frames 200*b*, and a grooved engaging member 213*b* provided with a circumferential engagement groove 213*a* is fixed to it.

A brush roller 201 includes a hollow shaft portion 201*a*, a plurality of cleaning brushes (five cleaning brushes in this embodiment) 250 fixed to the hollow shaft portion 201*a* by screws 251, and a pair of connecting members 201*b* fixed to the two ends, respectively, of the hollow shaft portion 201*a*. The plurality of cleaning brushes 250 are arranged in correspondence with the numbering devices 50 of the number cylinder 15. That is, as shown in FIG. 5, cleaning brushes 250 are arranged at the same axial positions as the numbering devices 50 in a number equal to the number of numbering devices 50, so that a plurality of cleaning brushes 250 come into contact with a plurality of numbering devices 50, respectively, on each numbering device line 50*d* as the brush roller unit 200 is mounted on the main body frames 3*a*.

One of the pair of connecting members 201*b* fitted at the two ends, respectively, of the brush roller 201 is fastened to the rotary shaft 210 by a bolt 220, and the other is fastened to the swing shaft 213 by a bolt 220. A rotary drive motor 202 is fixed to one of the sub-frames 200*b* of the brush roller unit 200, and a gear 202*b* is fixed to the rotary shaft of the rotary drive motor 202 to mesh with the gear 211 of the rotary shaft 210. A swing drive motor 203 is fixed to the other of the sub-frames 200*b*, and a grooved cam 203*b* including a circumferential engagement groove 203*c* having a given tilt with respect to the circumferential direction is fixed to the rotary shaft of the swing drive motor 203.

A mount table 231 is fixed to the other of the sub-frames 200*b*, and a lever 230 is supported by the mount table 231 to be swingable around a pin 231*a*. The mount table 231 has its one end provided with a cam follower 230*a* which engages with the engagement groove 203*c* in the grooved cam 203*b*. The mount table 231 has its other end provided with a roller 230*b* which engages with the engagement groove 213*a* in the grooved engaging member 213*b*.

The motor 202, gears 211 and 202*b*, and rotary shaft 210 constitute a brush rotating device. The motor 203, grooved cam 203*b*, cam follower 230*a*, lever 230, roller 230*b*, and grooved engaging member 213*b* constitute a brush reciprocating device. The brush rotating device and brush reciprocating device constitute a brush member drive device 508. Note that the brush member drive device 508 need not always include both the brush rotating device and brush reciprocating device, and need only include at least one of them. Also, instead of brush reciprocation, the cleaning brushes 250 may move in a plurality of directions almost parallel to the contact surfaces (in arcuated or oblique directions) with the numbering devices 50 while the numbering devices 50 of each of the number cylinders 14 and 15 remain in contact with the cleaning brushes 250 in a one-to-one correspondence.

<Arrangement of Number Inker Cleaning Device>

The arrangement of a number inker cleaning device 300 which cleans the ink fountain roller 301 of each of the number inkers 20*a* and 20*b* using a doctor 71 will be described below with reference to FIG. 6. Note that since the number inkers 20*a* and 20*b* have the same arrangement, the number inker 20*a* will be taken as an example hereinafter for the sake of convenience.

The number inker 20*a* including an ink fountain 312 is mounted on the pair of inker frames 100*a* of the moving inker 100. The ink fountain 312 is slidably supported on a pair of slide rails 311*b* extending in a direction coming close to or away from the ink fountain roller 301. Upon this operation, the ink fountain 312 reciprocally moves between a proximity position at which it reaches a position in close proximity to the ink fountain roller 301, and a retraction position (FIG. 6) at which it separates from the ink fountain roller 301. A pivot shaft 81*a* is pivotally supported by the end of the slide rails 311*b* on the side of the ink fountain roller 301, and a doctor holding member 70 is fixed to the pivot shaft 81*a*. The doctor 71 is removably fastened to the doctor holding member 70 by, for example, a bolt.

Ink fountain position detectors 511*a* and 511*b* implemented by photoelectric sensors which detect the position of the ink fountain 312 are mounted on the slide rails 311*b*. The detector 511*a* is disposed at the end of the slide rails 311*b* on the side of the ink fountain roller 301, and detects that the ink fountain 312 is set at an actuation position. The detector 511*b* is disposed at the end of the slide rails 311*b* on the side opposite to that of the ink fountain roller 301, and detects that the ink fountain 312 is set at a retraction position.

The doctor 71 includes a doctor blade 74 formed at its distal end, and a receiving tray 71*a* having a cleaning liquid accommodation space formed in it. The doctor blade 74 has a length nearly equal to the axial length of the circumferential surface of the ink fountain roller 301, and its distal end abuts against the ink fountain roller 301. The receiving tray 71*a* to which the proximal end of the doctor blade 74 is fixed is formed in a roughly rectangular shape with a length nearly equal to the axial length of the circumferential surface of the ink fountain roller 301.

An arm 81 has its one end fixed to the pivot shaft 81*a*, and its other end pivotally supported by a distal end 80*c* of a rod 80*e* of an air cylinder 80. A proximal end 80*b* of the air cylinder 80 is pivotally, axially supported by a shaft 78*a* protruding from a support plate 78 fixed to the inker frames 100*a*. When the rod 80*e* of the air cylinder 80 extends, the doctor 71 is set at a detachment position at which the distal end of the doctor blade 74 separates from the circumferential surface of the ink fountain roller 301, as shown in FIG. 6. On the other hand, when the rod 80*e* of the air cylinder 80 retracts, the doctor 71 is set at an attachment position (cleaning position) at which the distal end of the doctor blade 74 comes into contact with the circumferential surface of the ink fountain roller 301. The doctor holding member 70, pivot shaft 81*a*, air cylinder 80, and arm 81 constitute a doctor attaching device.

The doctor 71 includes a cover 77 which is mounted on a support column 76 fixed to the lower portion of the side wall of the receiving tray 71*a* on the side of the ink fountain roller 301, and extends toward a position below the doctor 71. The cover 77 covers the ink fountain roller 301 in the portion below the doctor 71 to protect the ink fountain roller 301 against foreign substances that enter from the side of the number inker 20*a*. The doctor holding member 70 is equipped with a doctor detector 512 which detects that the doctor 71 is mounted on the doctor holding member 70.

In the number inker 20*a*, a spray nozzle (cleaning liquid supply device) 82 is supported by the inker frames 100*a* to face the ink fountain roller 301. The spray nozzle 82 sprays a cleaning liquid containing a solvent for cleaning the ink fountain roller 301 to a position above the ink fountain roller 301. The spray nozzle 82 is connected to a solenoid valve 82*a* (FIG. 7) which switches on or off the spray of the cleaning liquid from the spray nozzle 82. The spray nozzle 82 and solenoid valve 82*a* constitute a cleaning liquid supply device. The doctor 71, the doctor attaching device (for example, the air cylinder 80), and the cleaning liquid supply device (for example, the spray nozzle 82) constitute the number inker cleaning device 300.

A receiving tray 86 which receives the cleaning liquid dripped from the spray nozzle 82 is disposed below the spray nozzle 82, while a fixed pan 99 which receives the ink and cleaning liquid is disposed below the ink fountain roller 301. An ink pan 312*b* is disposed in a bracket 312*a* disposed in the lower portion of the ink fountain 312. The ink pan 312*b* is positioned below the distal end of the ink fountain and receives the ink and cleaning liquid.

<Electrical Arrangement which Performs Cleaning Processes for Number Cylinders and Number Inkers>

An electrical arrangement which performs a cleaning process for the numbering devices 50 of the number cylinders 14 and 15, and a cleaning process for the ink fountain rollers 301 (and inker roller groups) of the number inkers 20*a* and 20*b* in the numbering and imprinting machine 1 will be described below.

Figure 7:
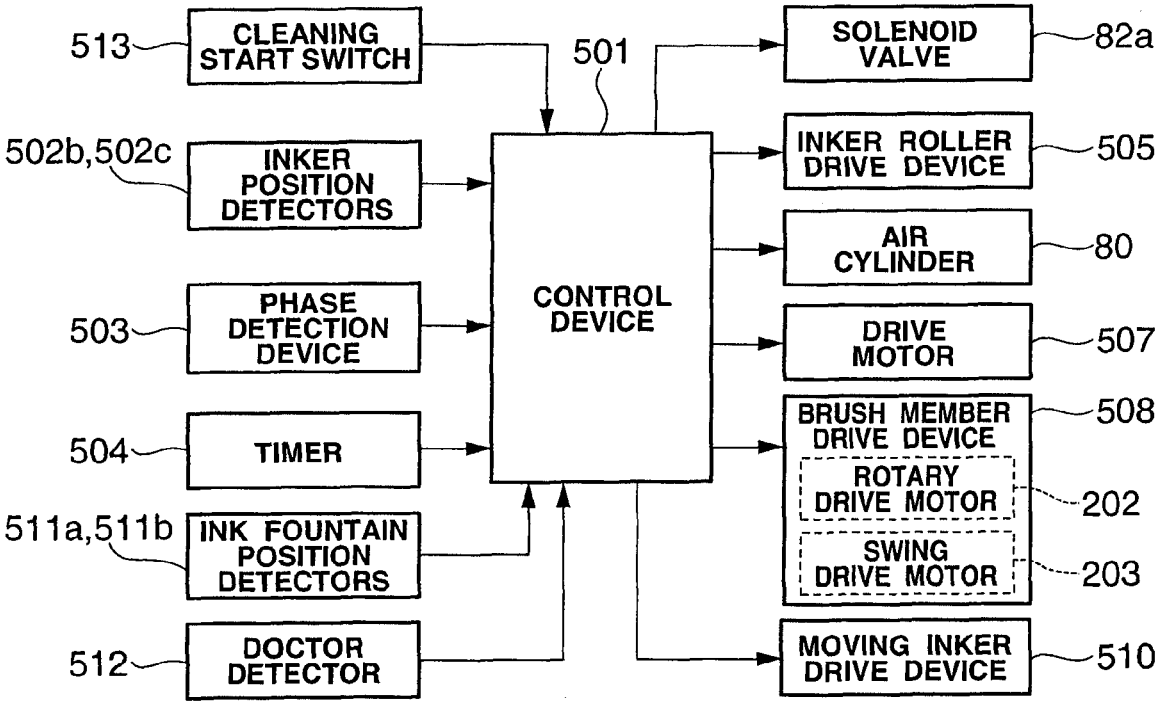
FIG. 7 is a block diagram showing an electrical arrangement which performs cleaning processes for the number cylinders and the ink fountain roller.

The numbering and imprinting machine 1 includes a control device 501 including a CPU (Central Processing Unit) which controls various types of processes including the cleaning processes, as shown in FIG. 7. The control device 501 is connected to the inker position detectors 502*b* and 502*c* serving as inker position detection means, a phase detection device 503 implemented by, for example, a rotary encoder which detects the rotary phases of the number cylinders 14 and 15, a timer 504 which measures various times, a cleaning start switch 513, the ink fountain position detectors 511*a* and 511*b*, and the doctor detector 512.

The control device 501 is also connected to an inker roller drive device 505 implemented by a motor which rotates the inker roller groups of the number inkers 20*a* and 20*b*, the air cylinder 80 which moves the doctor 71, a drive motor 507 which serves as a main motor for driving the numbering and imprinting machine 1 and rotates the number cylinders 14 and 15, the brush member drive device 508 (including the rotary drive motor 202 and swing drive motor 203) which moves the cleaning brushes 250, the moving inker drive device 510 which moves the moving inker 100, and the solenoid valve 82*a* of the spray nozzle 82.

<Printing Operation of Numbering and Imprinting Machine>

The printing operation of the numbering and imprinting machine 1 configured as mentioned above will be described below. The numbering and imprinting machine 1 performs its printing operation when the moving inker 100 is set at the printing position by the moving inker drive device 510, as shown in FIG. 1. More specifically, the detector 502*b* detects the object to be detected 502*a* when the moving inker 100 is set at the printing position. Upon this operation, the control device 501 controls driving of the drive motor 507 and inker roller drive device 505 at the printing speed.

As the numbering and imprinting machine 1 is activated, the sheets 5 on the pile board 7 of the feed unit 2 are drawn by suction one by one and fed to the feeder board 6 by the sucker device (not shown). The sheets 5 on the feeder board 6 are sequentially transferred from the swing arm shaft pregripper 8 onto the impression cylinder 12 of the printing unit 3 via the gripper devices of the transfer cylinders 9, 10, and 11.

The sheet 5 transferred onto the impression cylinder 12 is conveyed with the rotation of the impression cylinder 12, and passes between the impression cylinder 12 and the stamp cylinder 13. At this time, a stamp is printed on the printed sheet 5 with ink, supplied from the stamp inker 19, through the stamp cylinder 13. The sheet 5 conveyed with the rotation of the impression cylinder 12 passes between the impression cylinder 12 and the number cylinder 14. At this time, a first number is printed on the printed sheet 5 with ink, supplied from the number inker 20*a*, through the number cylinder 14. As the impression cylinder 12 further rotates, the sheet 5 passes between the impression cylinder 12 and the number cylinder 15. At this time, a second number is printed on the printed sheet 5 with ink, supplied from the number inker 20*b*, through the number cylinder 15.

The sheet 5 having the stamp and numbers printed on it is transferred by the gripper device of the inspection cylinder 17 via the transfer cylinder 16, and conveyed. At this time, the sheet 5 is drawn by suction by suction air from the large number of suction holes formed in the circumferential surface of the inspection cylinder 17. The positions and densities of the stamp and numbers of the sheet 5 conveyed in tight contact with the circumferential surface of the inspection cylinder 17 are inspected by the inspection cameras 101 and 102. The sheet 5 inspected by the inspection cameras 101 and 102 is transferred to the gripper bars 24, is conveyed as the delivery chains 23 travel, and is delivered to the delivery unit 4.

A sheet 5 determined to be fit by the control device 501 based on the image data captured by the inspection cameras 101 and 102 is delivered to the fit sheet delivery device 31 or 32. A sheet 5 determined to be unfit by the control device 501 based on the image data captured by the inspection cameras 101 and 102 is delivered to the unfit sheet delivery device 33.

Figure 2:
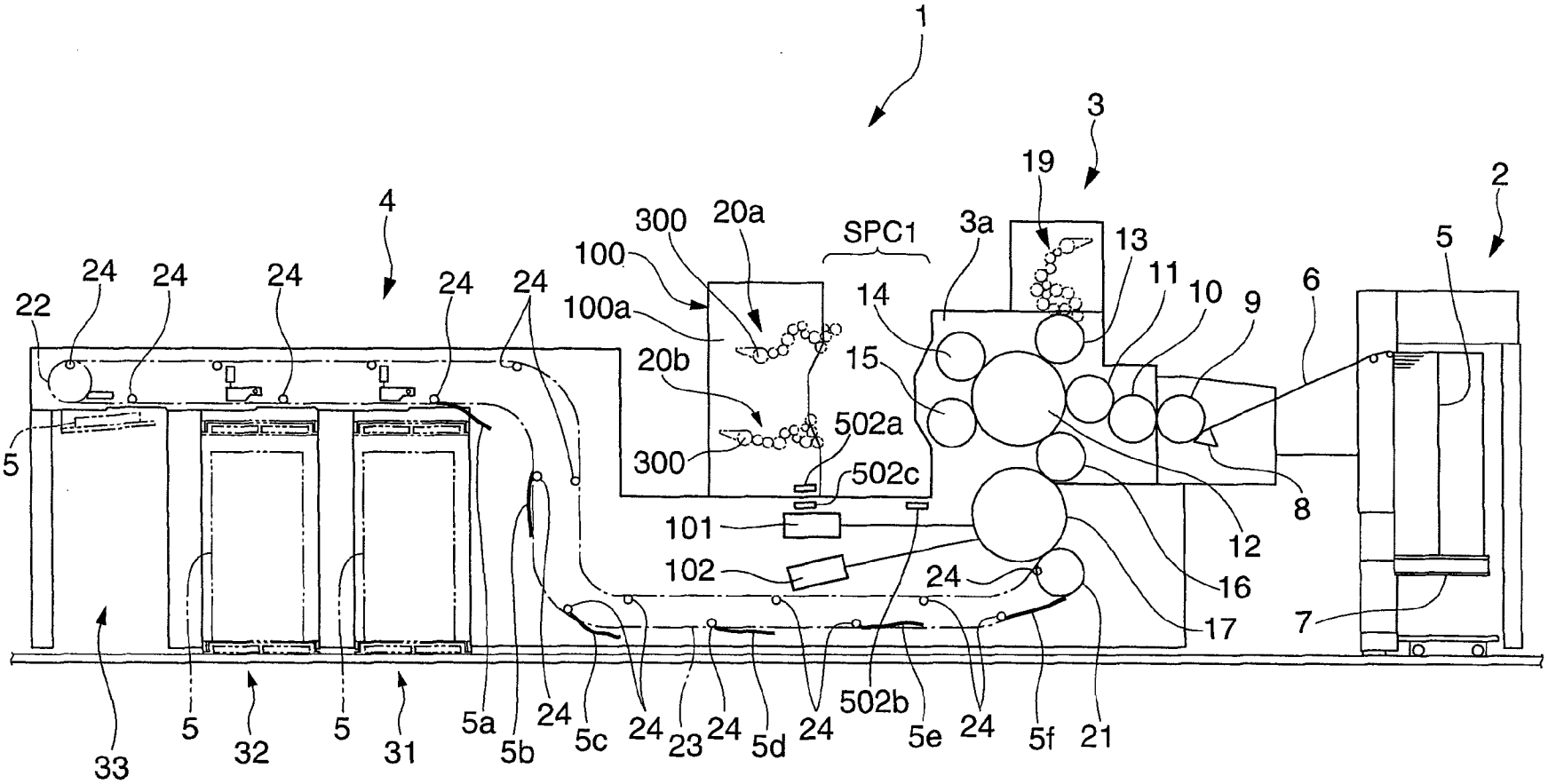
FIG. 2 is a side view showing the numbering and imprinting machine when a moving inker shown in FIG. 1 has moved to a retraction position.

On the other hand, as the moving inker drive device 510 is driven, the moving inker 100 separates from the main body frames 3*a* of the printing unit 3 and is set at the retraction position, as shown in FIG. 2. At this time, the number inkers 20*a* and 20*b* also separate from the number cylinders 14 and 15, respectively, to form a maintenance space SPC1 between the inker frames 100*a* and the number cylinders 14 and 15 supported by the main body frames 3*a* of the printing unit 3. The maintenance space SPC1 has an area large enough to allow the operator to enter and to perform the maintenance operation of, for example, the impression cylinder 12.

After the operator enters the maintenance space SPC1, he or she executes a maintenance operation including dirt wiping and replacement of the top sheet mounted on the circumferential surface of the impression cylinder 12, and a mounting and removing operation (to be described later) for the brush roller unit 200.

At this time, the control device 501 drives the drive motor 507 and inker roller drive device 505 at a predetermined speed or inhibits their driving at the printing speed, only when the operator who has entered the maintenance space SPC1 performs press button operations. Note that the control device 501 may perform such control when the detector 502*b* has detected that the object to be detected 502*a* is absent (the moving inker 100 is not set at the printing position).

When a printing process on the sheet 5 is complete, the number cylinders 14 and 15 and the number inkers 20*a* and 20*b* are cleaned simultaneously. Prior to the cleaning, the brush roller unit 200 and doctor 71 are mounted on the numbering and imprinting machine 1.

<Mounting of Brush Roller Unit>

As the moving inker 100 is set at the retraction position, the operator enters the maintenance space SPC1 to mount the brush roller unit 200 on the numbering and imprinting machine 1. More specifically, the end shafts 202*a* of the brush roller unit 200 are fitted in the recesses of the receptacles 151 of the main body frames 3*a*. The bolts 153 are pivoted about the pins 152 to fit the shafts of the bolts 153 in the recesses of the brackets 156 of the brush roller unit 200. The lock nuts 154 are tightened to clamp the brackets 156 between the lock nuts 154 and the heads 155, and the brackets 156 are fastened by the bolts 153.

In this manner, when the brush roller unit 200 is mounted on the main body frames 3*a*, a plurality of cleaning brushes 250 of the brush roller 201 come into contact with a plurality of numbering devices 50, respectively, on each numbering device line of each of the number cylinders 14 and 15, as shown in FIG. 5.

The contact pressure acting on the numbering devices 50 of the cleaning brushes 250 is adjusted through the heads 155 of the bolts 153, which are equipped with the adjusting dials. More specifically, the lock nuts 154 are loosened to cancel the fastening of the brackets 156 by the lock nuts 154 and heads 155. When the heads 155 rotate in one direction, the bolts 153 threadably engaging with the internal threads of the projecting portions 152*a* of the pins 152 move by a screwing action, and the brush roller 201 moves in a direction coming close to the number cylinder 15 (upwards in FIG. 5). Upon this operation, the plurality of cleaning brushes 250 of the brush roller 201 come close to each numbering device line of each of the number cylinders 14 and 15, thus increasing the contact pressure acting between the plurality of cleaning brushes 250 and the plurality of numbering devices 50.

On the other hand, when the heads 155 equipped with the adjusting dials rotate in the other direction, the bolts 153 move in the direction opposite to that mentioned above, so the brush roller 201 moves in a direction away from the number cylinder 15 (downwards in FIG. 5). Upon this operation, the plurality of cleaning brushes 250 of the brush roller 201 separate from each numbering device line of each of the number cylinders 14 and 15, thus decreasing the contact pressure acting between the plurality of cleaning brushes 250 and the plurality of numbering devices 50. After this contact pressure is adjusted, the lock nuts 154 are tightened to clamp the brackets 156 between the lock nuts 154 and the heads 155, and the brackets 156 are fastened by the bolts 153.

After the brush roller unit 200 is mounted on the main body frames 3*a*, the detector 502*b* detects the object to be detected 502*a* as the moving inker 100 is set at the printing position. When the control device 501 determines that the moving inker 100 is set at the printing position, it enables driving of the drive motor 507 at the cleaning speed. This makes it possible to clean the number cylinders 14 and 15.

<Attachment of Doctor>

After the brush roller unit 200 is mounted on the main body frames 3*a*, the doctor 71 is attached to each of the number inkers 20*a* and 20*b*. While the ink fountain roller 301 and the large number of inker rollers are kept stopped, the operator manually moves the ink fountain 312 to a retraction position indicated by an alternate long and two short dashed line in FIG. 6, and the doctor 71 is mounted on the doctor holding member 70, as shown in FIG. 6. In mounting the doctor 71 on the doctor holding member 70, the rod 80*e* of the air cylinder 80 extends, and this means that the doctor 71 is set at the detachment position (FIG. 6).

As the ink fountain 312 moves to the retraction position, the ink fountain position detector 511*b* detects the ink fountain 312. Upon this operation, the control device 501 inhibits driving of the drive motor 507 and inker roller drive device 505 at the printing speed. When the doctor 71 is mounted on the doctor holding member 70, the doctor detector 512 detects the doctor 71. Upon the detection of the ink fountain 312 by the ink fountain position detector 511*b*, and the detection of the doctor 71 by the doctor detector 512, the control device 501 drives the inker roller drive device 505 at the cleaning speed, and enables cleaning of the number inkers 20*a* and 20*b*.

When the moving inker 100 is set at the printing position while the brush roller unit 200 and doctor 71 are mounted, the inker position detector 502*b* detects the object to be detected 502*a*, the ink fountain position detector 511*b* detects the ink fountain 312, and the doctor detector 512 detects the doctor 71. When all of these conditions are satisfied, the control device 501 enables simultaneous cleaning of the number cylinders 14 and 15 and the number inkers 20*a* and 20*b*.

That is, as the operator operates the cleaning start switch 513, the control device 501 drives the drive motor 507 and inker roller drive device 505 at the cleaning speed. The control device 501 also controls the rotary drive motor 202, swing drive motor 203, air cylinder 80, and solenoid valve 82*a* to simultaneously clean the number inkers 20*a* and 20*b* and the numbering devices 50 of the number cylinders 14 and 15.

<Cleaning Operation for Numbering Devices by Brush Roller Unit>

A cleaning process for the plurality of numbering devices 50 which form the numbering device lines of each of the number cylinders 14 and 15 by the brush roller unit 200 will be described first. A cleaning process for the numbering devices 50 of the number cylinder 15 will be exemplified hereinafter for the sake of convenience. The control device 501 drives the drive motor 507, based on the output from the phase detection device 503, so as to oppose the numbering device line 50*d* of the number cylinder 15 to the brush roller unit 200. When the numbering device line 50*d* is set at the position (phase) opposite to the brush roller unit 200, the control device 501 controls the drive motor 507 to stop the rotation of the number cylinder 15.

After the number cylinder 15 stops, the control device 501 drives the rotary drive motor 202 and swing drive motor 203 of the brush member drive device 508. Upon the driving of the rotary drive motor 202, the rotary shaft 210 is rotated through the gears 202*b* and 211, so the brush roller 201 connected to the rotary shaft 210 rotates. The plurality of cleaning brushes 250 are integrally mounted on the brush roller 201 in its axial direction, and therefore rotate with the rotation of the brush roller 201.

At the same time, upon the driving of the swing drive motor 203, the cam follower 230*a* which engages with the engagement groove 203*c* in the grooved cam 203*b* reciprocally moves in the axial direction of the rotary shaft of the swing drive motor 203 along the tilt of the engagement groove 203*c*. Upon the reciprocal movement of the cam follower 230*a*, the lever 230 swings around the pin 231*a*, so the roller 230*b* reciprocally moves in the axial direction of the swing shaft 213. Upon the reciprocal movement of the roller 230*b*, the grooved engaging member 213*b* which engages with the roller 230*b* reciprocally moves in the axial direction of the swing shaft 213 together with the swing shaft 213, so the brush roller 201 and rotary shaft 210 reciprocally move in the axial direction of the brush roller 201. Upon this operation, the cleaning brushes 250 mounted on the brush roller 201 reciprocally move in the axial direction of the brush roller 201. At this time, the gear 211 of the rotary shaft 210 reciprocally moves in the tooth widthwise direction of the gear 202*b* while meshing with the gear 202*b*.

In this manner, while the plurality of cleaning brushes 250 mounted on the brush roller 201 remain in contact with the aligning print wheels 50*b*, the cleaning brushes 250 rotate and reciprocally move (swing) in the axial direction of the brush roller 201. In other words, the cleaning brushes 250 move in a plurality of directions almost parallel to the contact surfaces with the aligning print wheels 50*b*. At this time, since the cleaning brushes 250 move in a plurality of directions relative to the print wheels 50*b*, it is possible to easily, efficiently scrape the residual ink adhered to the print wheel 50*b* in a short period of time, thus dramatically improving the cleaning effect.

The control device 501 controls the rotary drive motor 202 and swing drive motor 203 so that the cleaning brushes 250 perform a cleaning operation for one numbering device line 50*d* for a preset period of time. More specifically, as the timer 504 measures a first setting time (numbering device line cleaning time) from the start of cleaning (the start of motor driving) which is preset in advance, the control device 501 stops the rotary drive motor 202 and swing drive motor 203. This operation prevents the brush roller 201 from being wastefully rotated or swung to suppress wasteful power consumption. This operation can also prevent the ink and cleaning liquid adhered to the cleaning brushes 250 from scattering to their surroundings upon their rotation and reciprocal movement between repeated cleaning processes of the numbering device line 50*d*.

When a cleaning operation for one numbering device line 50*d* is complete, the control device 501 drives the drive motor 507, based on the detection result obtained by the phase detection device 503, so as to oppose the next numbering device line 50*e* adjacent to the numbering device line 50*d* to the cleaning brushes 250. When the next numbering device line 50*e* is set at the position opposite to the brush roller unit 200, the control device 501 controls the drive motor 507 to stop the rotation of the number cylinder 15. Subsequently, a cleaning operation for the numbering devices 50 of the next numbering device line 50*e* is performed in the same way as in the numbering device line 50*d*.

In this manner, the brush roller unit 200 sequentially performs a cleaning operation for the next numbering device line 50*e* adjacent to the cleaned numbering device line 50*d*. Note that the phase of the numbering device lines mounted on the number cylinder 15 is set in the control device 501 in advance. If the number or arrangement interval of numbering device lines is changed upon a change in printing specification, the operator resets the phase of the changed numbering device lines.

In this embodiment, two number cylinders are provided, so the number cylinders 14 and 15 interlock with each other and rotate upon driving of the drive motor 507. In such an arrangement, when the two number cylinders 14 and 15 are cleaned, the numbering device lines of the number cylinder 14 may be cleaned after those of the number cylinder 15 are cleaned. Alternatively, the numbering device lines of the number cylinders 14 and 15 may be cleaned in an order, which minimizes the cleaning time, in consideration of the phases of the numbering device lines of both the number cylinders 14 and 15. More specifically, after one numbering device line of the number cylinder 15 is cleaned, before the next numbering device line of the number cylinder 15 is opposed to the brush roller unit 200, a numbering device line of the number cylinder 14, which is opposed to the brush roller unit 200, is cleaned first. Subsequently, the next numbering device line of the number cylinder 15 is cleaned.

<Cleaning Operation for Number Inkers by Doctor>

A cleaning operation for the number inkers 20*a* and 20*b* by the doctor 71 will be described next. A cleaning operation for the number inker 20*a* will be exemplified hereinafter for the sake of convenience.

In cleaning the number inker 20*a*, first, a cleaning liquid is sprayed from the spray nozzle 82 onto the circumferential surface of the rotating ink fountain roller 301 through the solenoid valve 82*a*. The air cylinder 80 is driven to press the doctor blade 74 of the doctor 71 against the circumferential surface of the ink fountain roller 301.

Figure 6:
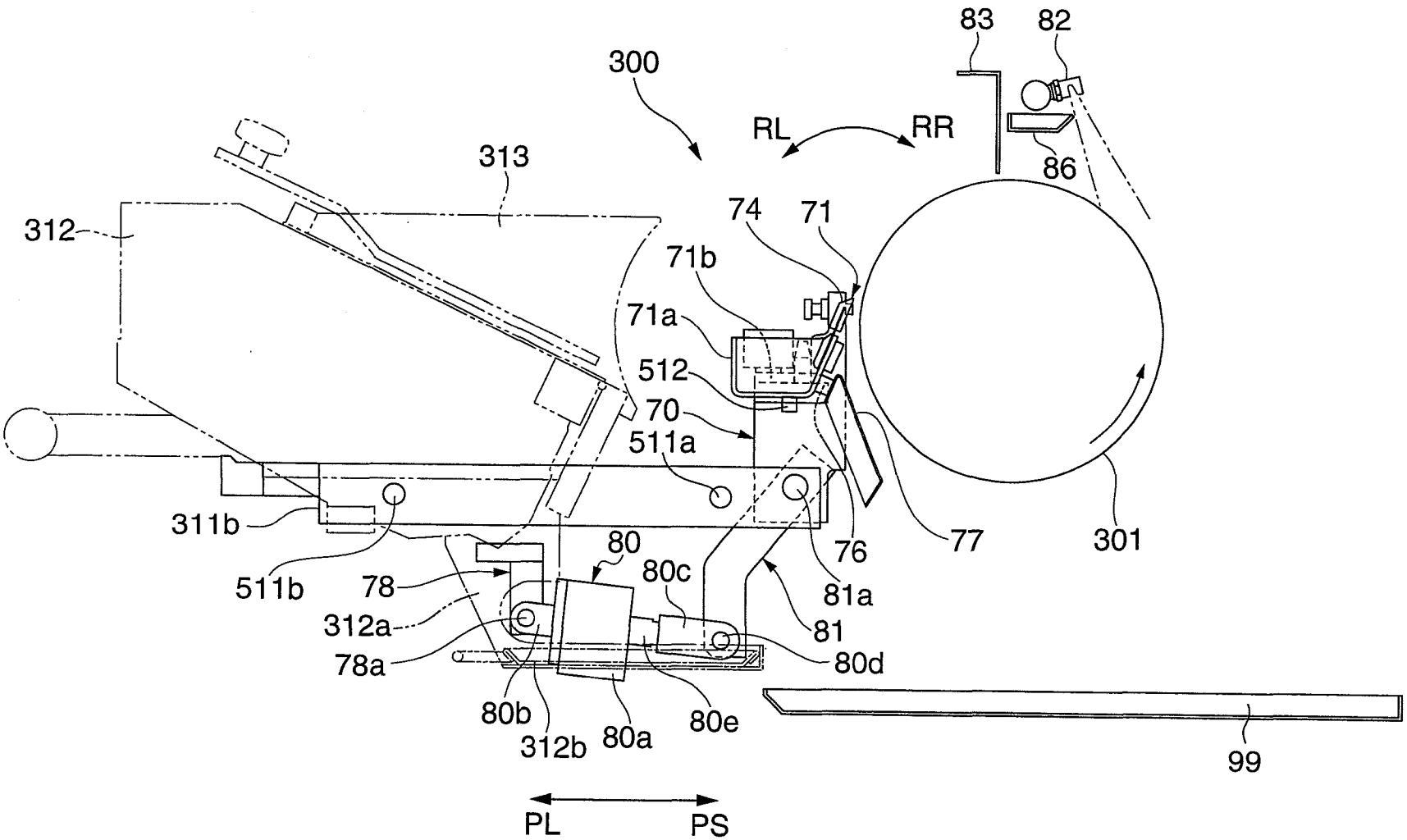
FIG. 6 is a side view showing how to clean an ink fountain roller using a doctor.

At this time, the control device 501 drives the inker roller drive device 505 to rotate the ink fountain roller 301 and the large number of inker rollers in the direction in which ink is supplied (in the circumferential direction of the ink fountain roller 301, which is indicated by an arrow in FIG. 6). The solenoid valve 82*a* is controlled to spray a cleaning liquid from the spray nozzle 82 onto the circumferential surface of the ink fountain roller 301.

The cleaning liquid sprayed onto the circumferential surface of the ink fountain roller 301 is supplied onto inker rollers other than that, which abuts against the ink fountain roller 301, via the abutting inker roller, and the ink adhered to the circumferential surfaces of all inker rollers is dissolved in the cleaning liquid. The control device 501 retracts the piston rod 80*e* of the air cylinder 80 in the direction opposite to the side of the ink fountain roller 301 (a direction indicated by an arrow PL). Upon this operation, the doctor holding member 70 and doctor 71 pivot in a direction coming close to the ink fountain roller 301 (a direction indicated by an arrow RR) through the pivot shaft 81*a*, and the doctor 71 is set at the attachment position.

The ink on the circumferential surface of the ink fountain roller 301 is dissolved in the cleaning liquid in the form of a waste liquid, which is scraped by the doctor blade 74, and collects in the receiving tray 71*a*. At this time, the fixed pan 99 collects the ink and cleaning liquid that have dripped from the ink fountain roller 301. A waste liquid from the inker roller group is also scraped by the doctor blade 74 through the ink fountain roller 301, and collects in the receiving tray 71*a*. In this way, the ink fountain roller 301 and all inker rollers which are directly or indirectly connected to the ink fountain roller 301 to allow interlocked rotation are cleaned.

As the timer 504 measures a second setting time (cleaning liquid spray time) which is preset in advance, the control device 501 controls the solenoid valve 82*a* to stop the spray of a cleaning liquid from the spray nozzle 82. Even after the spray of a cleaning liquid stops, the doctor blade 74 is pressed against the ink fountain roller 301, so the cleaning liquid adhered to the ink fountain roller 301 and the circumferential surfaces of the large number of inker rollers is continuously scraped by the doctor blade 74. As the timer 504 further measures a preset, third setting time (ink fountain roller cleaning time), the control device 501 extends the piston rod 80*e* of the air cylinder 80 (a direction indicated by an arrow PS), and moves the doctor holding member 70 and doctor 71 in a direction away from the ink fountain roller 301 (a direction indicated by an arrow RL) through the pivot shaft 81*a*. As a result, the doctor 71 is set at the detachment position. At the same time, the control device 501 stops the driving of the inker roller drive device 505, so the ink fountain roller 301 and inker roller group stop their rotation operations.

When all cleaning operations for the number cylinders 14 and 15 and number inkers 20*a* and 20*b* are complete, the operator removes the brush roller unit 200 and doctor 71. More specifically, the operator removes the doctor 71 from the doctor holding member 70, retracts it outside the machine, and manually moves the ink fountain 312 from the retraction position indicated by the alternate long and two short dashed line in FIG. 6 to the proximity position. As the doctor 71 is removed from the doctor holding member 70, the doctor detector 512 can no longer detect the doctor 71. On the other hand, as the ink fountain 312 moves to the proximity position, the ink fountain position detector 511*a* detects the ink fountain 312. Upon this operation, the control device 501 enables driving of the inker roller drive device 505 at the printing speed.

The operator sets the moving inker 100 at the retraction position, enters the maintenance space SPC1, and removes the brush roller unit 200. More specifically, the lock nuts 154 are loosened to cancel the fastening of the brackets 156 by the lock nuts 154 and heads 155. The bolts 153 are removed from the recesses in the brackets 156 to remove the end shaft 202*a* of the brush roller unit 200 from the recesses in the receptacles 151 of the main body frames 3*a*. With this operation, the entire brush roller unit 200 is removed from the main body frames 3*a*. After the brush roller unit 200 is removed from the main body frames 3*a*, the moving inker 100 is set at the printing position.

As the moving inker 100 is set at the printing position, the inker position detector 502*b* detects the object to be detected 502*a*. When all of the conditions: the doctor detector 512 does not detect the doctor 71, the ink fountain position detector 511*a* detects the ink fountain 312, and the inker position detector 502*b* detects the object to be detected 502*a* are satisfied, the control device 501 enables driving of the drive motor 507 and inker roller drive device 505 at the printing speed. This allows printing by the numbering and imprinting machine 1.

Other Embodiments

In the above-mentioned embodiment, when the inker position detectors 502*b* and 502*c* detect that the moving inker 100 is set at the printing position (FIGS. 1 and 3), the numbering devices of the number cylinders 14 and 15, and the circumferential surfaces of the ink fountain rollers 301 and inker roller groups of the number inkers 20*a* and 20*b* are cleaned simultaneously. However, the present invention is not limited to this, and the circumferential surfaces of the ink fountain roller 301 and inker roller group may be cleaned after cleaning of the numbering devices of the number cylinders 14 and 15. Alternatively, the order of numbering device cleaning and circumferential surface cleaning may be reversed.

Although a plurality of cleaning brushes 250 each having a width corresponding to that of each numbering device 50 are arranged in correspondence with the plurality of numbering devices 50 in the above-mentioned embodiment, one elongated cleaning brush that can come into contact with all of the plurality of numbering devices 50 at once may be used.

What is claimed is:

1. A numbering and imprinting machine comprising:

a number cylinder which is rotatably supported by main body frames, and includes at least one numbering device mounted on an outer circumferential surface thereof;

a moving inker which includes a number inker that supplies ink onto said number cylinder, and an inker frame on which said number inker is mounted, said moving inker being movable between a printing position at which said number inker comes into contact with said number cylinder, and a retraction position at which said number inker separates from said number cylinder to form a maintenance space between said inker frame and said number cylinder, said maintenance space allowing an operator to enter and to perform a maintenance operation therein;

a first cleaning device which is mounted on the main body frames, and cleans said number cylinder;

a second cleaning device which is mounted on said moving inker and cleans said number inker;

an inker position detector which detects a position of said moving inker; and a control device which, when said inker position detector detects that said moving inker is set at the printing position, rotates said number cylinder, drives said number inker and controls cleaning operations by said first cleaning device and said second cleaning device, and, when said inker position detector detects that said moving inker is set at the retraction position, inhibits said number cylinder from rotating at a printing speed and rotates said number cylinder only according to the operations performed by the operator who has entered the maintenance space.

2. A machine according to claim 1, wherein said first cleaning device includes a brush member which is movably supported by the main body frames, and moves in contact with said numbering device to clean said numbering device, and a brush member drive device which moves said brush member while said brush member is in contact with said numbering device, and said control device controls said brush member drive device to move said brush member when said moving inker is set at the printing position.

3. A machine according to claim 2, further comprising:

a drive motor which rotates said number cylinder; and a phase detection device which detects a rotary phase of said number cylinder, wherein said numbering device includes a plurality of numbering devices arranged to form a plurality of numbering device lines on each of which said plurality of numbering devices align themselves in an axial direction of said number cylinder, said numbering device lines being arranged at a predetermined interval in a circumferential direction of said number cylinder, and said control device controls said drive motor, based on the detection result obtained by said phase detection device, so as to stop said number cylinder while said brush member is in contact with one of said plurality of numbering device lines on each of which said plurality of numbering devices align themselves in the axial direction, and controls said brush member drive device to move said brush member in contact with said plurality of numbering devices which form the one of said plurality of numbering device lines.

4. A machine according to claim 3, wherein after the one of said plurality of numbering device lines is cleaned, said control device drives said drive motor, based on the detection result obtained by said phase detection device, so that said brush member comes into contact with the next numbering device line adjacent to the cleaned numbering device line in the circumferential direction of said number cylinder.

5. A machine according to claim 2, wherein said brush member is supported to be simultaneously movable in a plurality of directions substantially parallel to contact surfaces with said plurality of numbering devices, and said brush member drive device moves said brush member in the plurality of directions substantially parallel to the contact surfaces of said plurality of numbering devices.

6. A machine according to claim 5, wherein said brush member includes a brush roller supported to be rotatable and swingable in the axial direction, and said brush member drive device includes a brush rotary drive device which rotates said brush roller, and a brush swing drive device which swings said brush roller in the axial direction.

7. A machine according to claim 1, wherein said number inker includes a ink fountain roller that sullies ink onto said number cylinder, said second cleaning device includes a doctor which removes ink on a circumferential surface of the ink fountain roller as a distal end thereof comes into contact with the circumferential surface of the ink fountain roller, a doctor attaching device which moves said doctor between an attachment position at which the distal end of said doctor comes into contact with the circumferential surface of the ink fountain roller, and a detachment position at which the distal end of said doctor separates from the ink fountain roller, and a cleaning liquid supply device which supplies a cleaning liquid onto the circumferential surface of the ink fountain roller, and said control device controls said cleaning liquid supply device to supply the cleaning liquid onto the circumferential surface of the ink fountain roller, and controls said doctor attaching device to set said doctor at the attachment position, when said moving inker is set at the printing position.

8. A numbering and imprinting machine comprising:

a number cylinder including a plurality of numbering devices arranged to form a plurality of numbering device lines on each of which said plurality of numbering devices align themselves in an axial direction of said number cylinder, said numbering device lines being arranged circumferentially;

a drive motor which rotates said number cylinder;

a brush member which is supported movably and moves in contact with said numbering cylinder to clean said plurality of numbering devices;

a brush member drive device which moves said brush member in a plurality of directions substantially parallel to contact surfaces with said plurality of numbering devices;

a phase detection device which detects a rotary phase of said number cylinder; and a control device which controls said drive motor, based on the detection result obtained by said phase detection device, so as to stop said number cylinder while said brush member is in contact with one of said plurality of numbering devices which form one of said plurality of numbering device lines, and controls said brush member drive device to move said brush member in contact with the one of said plurality of numbering device lines.

* * * * *